US010100787B2

(12) United States Patent
Jin

(10) Patent No.: US 10,100,787 B2
(45) Date of Patent: Oct. 16, 2018

(54) EGR COOLER FOR VEHICLE

(71) Applicant: Hyundai Motor Company, Seoul (KR)

(72) Inventor: Seok Beom Jin, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/370,208

(22) Filed: Dec. 6, 2016

(65) Prior Publication Data

US 2018/0023521 A1 Jan. 25, 2018

(30) Foreign Application Priority Data

Jul. 22, 2016 (KR) ..... 10-2016-0093051

(51) Int. Cl.

| | |
|---|---|
| ***F02M 26/32*** | (2016.01) |
| ***F02M 26/30*** | (2016.01) |
| ***F02M 26/28*** | (2016.01) |
| ***F28F 9/00*** | (2006.01) |
| ***F28F 9/02*** | (2006.01) |
| ***F28F 21/08*** | (2006.01) |

(52) U.S. Cl.

CPC ..... *F02M 26/32* (2016.02); *F02M 26/28* (2016.02); *F28F 9/001* (2013.01); *F28F 9/0263* (2013.01); *F28F 21/084* (2013.01); *F28F 2009/0292* (2013.01)

(58) Field of Classification Search

CPC ..... F02M 26/32; F02M 26/28; F02M 26/17; F02M 26/23; F02M 26/29; F02M 26/30; F02M 26/41; F02M 26/73; F29F 9/001; F29F 9/0263; F29F 9/005; F29F 9/0265; F29F 9/0268; F29F 9/028; F29F 9/0282; F28F 21/084; F28F 2009/0292; F28F 2009/029; F28F 2215/04

USPC ..... 165/146, 147

See application file for complete search history.

(56) References Cited

U.S. PATENT DOCUMENTS

| | | | | |
|---|---|---|---|---|
| 5,970,960 | A * | 10/1999 | Azuma | F02M 35/10222 123/568.12 |
| 9,670,884 | B2 * | 6/2017 | Park | F02M 26/30 |
| 2004/0107949 | A1 * | 6/2004 | Miyoshi | F02M 26/57 123/568.12 |
| 2005/0098307 | A1 * | 5/2005 | Goto | F28D 7/1615 165/146 |
| 2005/0235972 | A1 * | 10/2005 | Yi | F02M 35/10085 123/568.12 |
| 2007/0068497 | A1 * | 3/2007 | Sugimoto | F02B 29/0475 123/568.12 |

(Continued)

FOREIGN PATENT DOCUMENTS

| | | |
|---|---|---|
| JP | 2014-169857 A | 9/2014 |
| KR | 10-0596021 B1 | 6/2006 |

*Primary Examiner* — Lindsay Low
*Assistant Examiner* — George Jin
(74) *Attorney, Agent, or Firm* — Morgan, Lewis & Bockius LLP

(57) ABSTRACT

An exhaust gas recirculation (EGR) cooler for a vehicle may include an intake pipe through which EGR gas flows; a core unit having an inlet connected to the intake pipe and may have a plurality of channels into which EGR gas flows through the intake pipe; a cooler housing that covers the core unit and through which cooling water flows to cool the cover unit; and a water jacket that covers the intake pipe, is connected to the cooler housing, and through which the cooling water flows to cool the intake pipe.

8 Claims, 2 Drawing Sheets

(56) References Cited

U.S. PATENT DOCUMENTS

| | | | | |
|---|---|---|---|---|
| 2008/0271722 | A1* | 11/2008 | Grunenwald | F28D 9/0043 123/568.12 |
| 2008/0302094 | A1* | 12/2008 | Yoon | F28D 7/0075 60/320 |
| 2015/0167595 | A1* | 6/2015 | Choi | F02B 29/0443 60/605.2 |
| 2015/0354508 | A1* | 12/2015 | Kobayashi | B22C 7/06 123/568.12 |
| 2016/0281580 | A1* | 9/2016 | Tabares | F02M 26/15 |
| 2016/0281649 | A1* | 9/2016 | Joisten-Pieritz | F02M 26/20 |

* cited by examiner

EGR COOLER FOR VEHICLE

CROSS REFERENCE TO RELATED APPLICATION

The present application claims priority to Korean Patent Application No. 10-2016-0093051, filed Jul. 22, 2016, the entire contents of which is incorporated herein for all purposes by this reference.

BACKGROUND OF THE INVENTION

Field of the Invention

The present invention relates to an exhaust gas recirculation (EGR) cooler for a vehicle and, more particularly, to an EGR cooler for cooling EGR gas in an EGR system that reduces noxious substances in exhaust gas by recirculating some of the exhaust gas to an intake system.

Description of Related Art

Exhaust gas that is discharged after a combustion process in an engine may contain incomplete combustion byproducts, depending on the combustion state, and incomplete combustion carbon oxides or nitrogen oxides may be representative of the incomplete combustion byproducts.

The incomplete combustion byproducts can be considered noxious substances that may have an adverse influence on the environment when discharged from vehicles, and various technologies have been developed to reduce the noxious substances.

There is a way of using an EGR system to remove such noxious substances. An EGR (Exhaust Gas Recirculation) system is a system that can reduce noxious substances by sending some of the exhaust gas containing noxious substances back to the intake system of an engine and burning them in the engine.

Meanwhile, EGR gas, which is a portion of the exhaust gas, has a high temperature after combustion in the engine. The high-temperature EGR gas may exert a bad influence on the EGR system, for example, causing unstable combustion in the engine when it is directly sent to the intake system, so an EGR cooler may be provided to cool the EGR gas.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing the cooling efficiency of an exhaust gas recirculation (EGR) cooler by increasing the cooling performance on the intake side through which EGR gas flows into the EGR cooler, and to improve the parts of the EGR cooler.

An exhaust gas recirculation (EGR) cooler for a vehicle may include an intake pipe through which EGR gas flows; a core unit having an inlet connected to the intake pipe and having a plurality of channels into which EGR gas flows through the intake pipe; a cooler housing that covers the core unit and through which cooling water flows to cool the cover unit; and a water jacket that covers the intake pipe and is connected to the cooler housing, and through which the cooling water flows to cool the intake pipe.

The core unit may include aluminum.

A cooling water inlet may be formed at the water jacket and the cooler housing may receive cooling water from the water jacket.

The cooling water inlet may be positioned to face an inlet of the intake pipe such that cooling water is discharged toward the inlet of the intake pipe.

A plurality of heat dissipation fins having lengths extending in a flow direction of EGR gas may be positioned in the intake pipe.

The heat dissipation fins may be arranged perpendicular to a flow direction of EGR gas and a distance between the heat dissipation fins may decrease moving toward the core unit so that a flow cross-sectional area of EGR gas decreases.

A thickness of the heat dissipation fins may increase moving toward the core unit to decrease the distance between the heat dissipation fins.

The heat dissipation fins may have different lengths in accordance with positions thereof.

The intake pipe may have an expanding section of which the internal cross-sectional area increases moving toward the core unit, and at least one of the heat dissipation fins may be arranged such that front ends facing an upstream side in the intake pipe are in contact with an inside of the expanding section.

The intake pipe may have a bending portion upstream side of the expanding section to change a longitudinal direction, and the curvature of the inside may sequentially change in a longitudinal direction through the bending portion and the expanding portion.

According to the EGR gas cooler for the vehicle of the present invention, it is possible to improve the cooling performance of the EGR cooler by improving the cooling performance at the inlet through which EGR gas flows inside, and to improve the material of the EGR cooler.

since the EGR cooler includes that water jacket positioned to cover the intake pipe corresponding to a passage through which EGR gas flows inside, it is possible to largely reduce the temperature of the EGR at the entrance of the EGR cooler.

Further, since the water jacket for cooling the intake pipe is provided to be configured to reduce the temperature of the EGR gas at the entrance, it is possible to use aluminum having a low temperature limit for the intake pipe and the core unit of the EGR cooler, so it is possible to improve the cooling performance and reduce the manufacturing cost.

Further, since the heat dissipation fins for improving heat exchange with EGR gas are positioned in the intake pipe, it is possible to improve the effect of reducing the temperature of EGR gas at the entrance of the EGR cooler.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
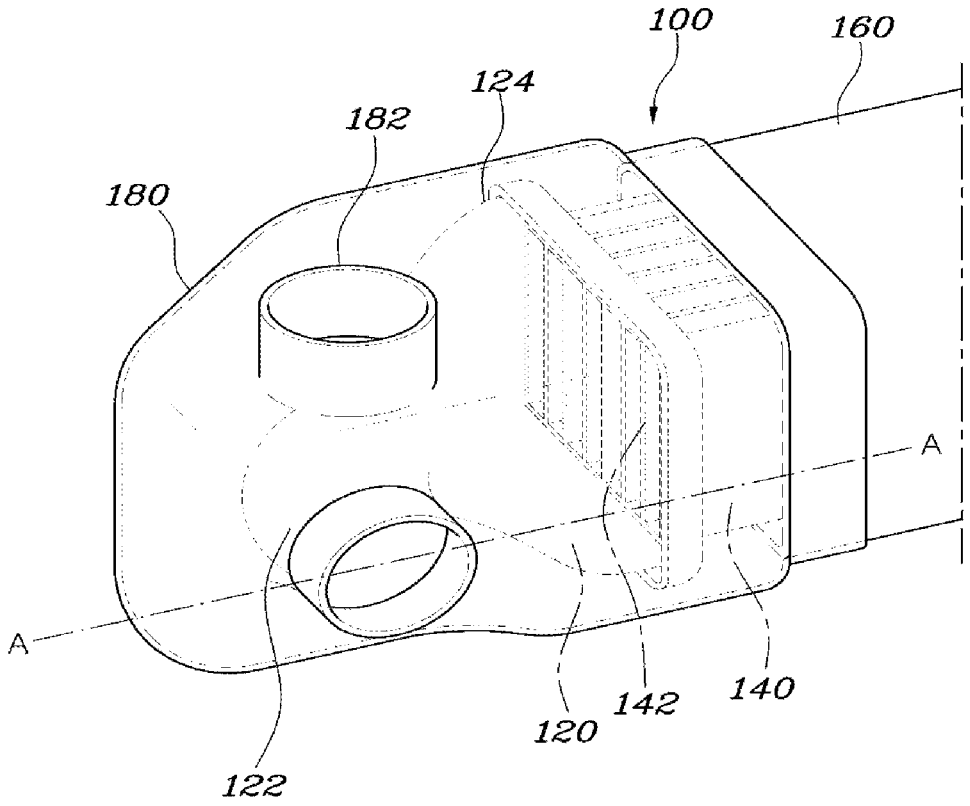
FIG. 1 is a view showing an exhaust gas recirculation (EGR) cooler for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, preferred embodiments of the present invention will be described in detail with reference to the accompanying drawings.

Figure 2:
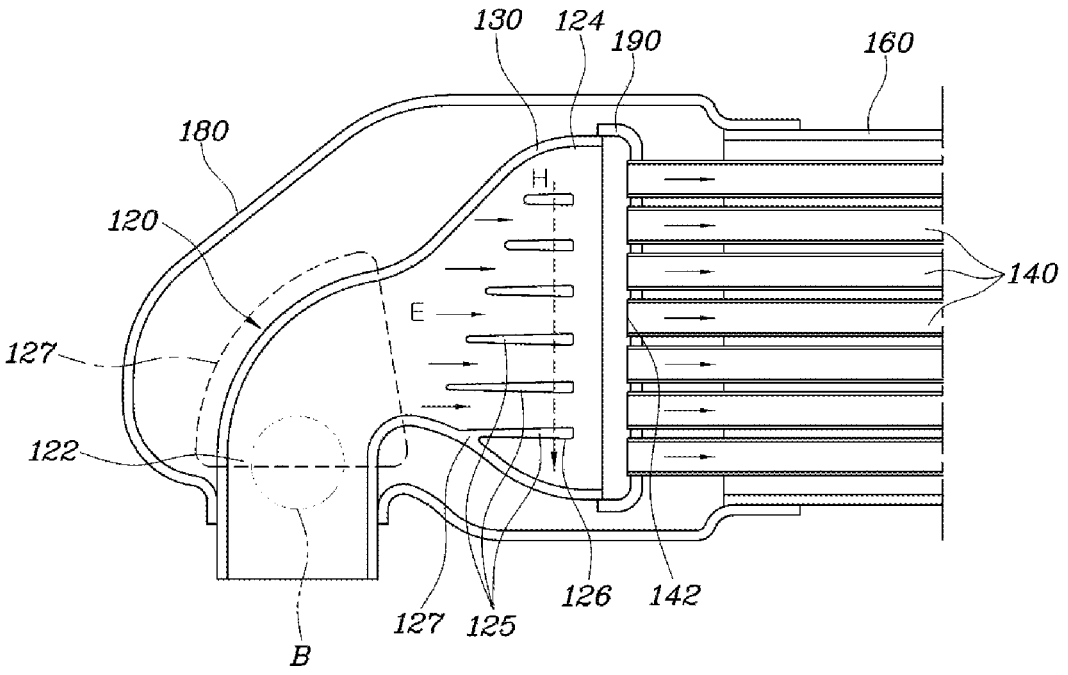
FIG. 2 is a view showing a cross-section taken along line A-A from the EGR cooler shown in FIG. 1.

An exhaust gas recirculation (EGR) cooler 100 for a vehicle according to an exemplary embodiment of the present invention, as shown in FIG. 1 and FIG. 2, includes: an intake pipe 120 through which EGR gas flows; a core unit 140 that has an inlet 142 connected to the intake pipe 120 and has a plurality of channels into which EGR gas flows through the intake pipe 120; a cooler housing 160 that covers the core unit 140 and through which cooling water flows to cool the cover unit 140; and a water jacket 180 that covers the intake pipe 120 and is connected to the cooler housing 160, and through which the cooling water flows to cool the intake pipe 120.

In detail, EGR gas flows through the intake pipe 120. The intake pipe 120 may be connected with an exhaust channel for discharging exhaust gas from an engine so that some of the exhaust gas flows through the intake pipe.

Further, although it will be described below, the intake pipe 120 may be defined as a channel covered by the water jacket 180, in which an outlet 124 of the intake pipe 120 becomes a channel that is connected to the inlet 142 of the core unit 140 to allow EGR gas, which is some of the exhaust gas flowing along an exhaust line, to flow to the core unit 140.

The shape of the intake pipe 120 may be variously determined, as required, and the intake pipe 120 shown in FIG. 1 is longitudinally bent to fit the shape of an engine compartment. The intake pipe 120 may include various materials, but the temperature of the exhaust gas flowing through the intake pipe 120 may be considered.

The intake pipe 120 is covered with the water jacket 160, which will be described below, in consideration of this matter in an exemplary embodiment of the present invention, whereby the intake pipe 120 may include aluminum etc. which is lower in temperature limit and higher an thermal conductivity than stainless steel etc., which is an advantage of the present invention.

The term "temperature limit" means the highest temperature at which the chemical and physical deformation of a material can be prevented or suppressed. That is, it can be understood that the higher the temperature limit of a material, the longer the material can maintain its shape and properties without deforming or burning at higher temperatures.

Meanwhile, the core unit 140 has an inlet 142 connected to the intake pipe 120 and has a plurality of channels through which EGR gas flows inward through the intake pipe 120. FIG. 1 shows the core unit 140 positioned in the cooler housing 160 with the inlet 142 connected to the intake pipe 120 and FIG. 2 shows a cross-section of the cover unit 140 in which a plurality of channels having a predetermined length is arranged in parallel with each other.

The channels of the core unit 140 may be formed in various shapes. For example, the channels may have a rectangular or circular cross-section or may be arranged in various shapes, for example, in a line or irregularly gathered in a group. Further, the channels may extend in various shapes, for example, they may be longitudinally curved or bent.

As an exemplary embodiment of the present invention in FIG. 1 and FIG. 2, the channels of the core unit 140 have a rectangular cross-section, are arranged parallel to each other in a first direction, and extend straight.

Although described below, cooling water flows around the core unit 140 and, for this purpose, the inlet 142 of the core unit 140 having the channels may be connected to the outlet 124 of the intake pipe 120. Further, a shield plate 190 may be mounted at in an exemplary embodiment of the present invention so that EGR gas flows through the intake pipe 120 and the core unit 140 without the cooling water flowing into the intake pipe 120 or the channels of the core unit 140.

The shield plate 190 is positioned between the outlet 124 of the intake pipe 1120 and the inlet 142 of the core unit 140 to block the opening of the intake pipe 120. Further, a slit is formed at the position corresponding to the inlet 142 of the core unit 140 to allow EGR gas to flow between the inlet pipe 120 and the core unit 140.

FIG. 2 shows the shield plate 190 having slits formed at positions corresponding to the channel inlets 142 of the core unit 140 to prevent cooling water from flowing into the intake pipe 120 or the core unit 140 and to allow EGR gas to flow between the intake pipe 120 and the core unit 140.

EGR gas flows through the channels of the core unit 140. The EGR gas comes from the intake pipe 120. The core unit 140 functions as a heat exchange passage for heat exchange between the EGR gas and an outside of the core unit 140.

Accordingly, the EGR gas flowing through the core unit 140 is cooled by losing heat to an outside through the core unit 140. To cool the EGR gas in this way, cooling water flows through the cooler housing 160 covering the core unit 140, which will be described below.

Various materials may be selected for the core unit 140 in consideration of the temperature of the EGR gas, similar to the intake pipe 120. Since the intake pipe 120 is covered with the water jacket 180 in an exemplary embodiment of the present invention, the temperature of the EGR gas is decreased at the early stage of inflow. Accordingly, the limit of temperature that the core unit 140 is required to tolerate is decreased, so the core unit 140 may include aluminum or the like, which has a temperature limit lower than that of stainless steel, which is an advantage of the present invention.

The cooler housing 160 covers the core unit 140 and cooling water for cooling the core unit 140 flows in the cooler housing 160. EGR gas is cooled by the EGR cooler 100 before flowing into the intake system to stabilize combustion in an engine and smoothly flow into the intake system, and the cooling water flows in the cooling housing 160 to cool the EGR gas flowing through the core unit 140.

The cooler housing 160 may include various materials and may have any of various shapes. However, the cooling housing 160 may be hermetically formed to prevent leakage and may be formed in a shape that covers the entire core unit 140 so that the cooling water flowing therein can stably come in contact with the entire core unit 140. Further, a baffle may be provided to change the flow direction of the cooling water or increase the speed of the cooling water so that EGR gas can be more effectively cooled.

The water jacket 180 covers the intake pipe 120 and is connected to the cooling housing 160, and the cooling water for cooling the intake pipe 120 flows through the water jacket 180.

The intake pipe 120 may be defined as the section covered by the water jacket 180. Accordingly, the inlet 122 of the intake pipe 120 may be the portion that is in contact with the inside of the water jacket 180 in accordance with the exemplary definition in an exemplary embodiment of the present invention, and the outlet 124 of the intake pipe may be the portion that is in contact with the inlet 142 of the core unit 140.

As described above, high-temperature EGR gas flows through the intake pipe 120 and the core unit 140 in an exemplary embodiment of the present invention. The section before EGR gas flowing through the core unit 140 is cooled, that is, the connection section between the intake pipe 120 and the core unit 140 is the section through which EGR gas at relatively high temperature flows.

Accordingly, the intake pipe 120 and the inlet 142 of the core unit 140 may include a material having a temperature limit that can resist high-temperature EGR gas. However, in an exemplary embodiment of the present invention, the temperature of the EGR gas flowing through the connection section between the intake pipe 120 and the core unit 140 is reduced by delivering cooling water around the intake pipe 120.

Since the intake pipe 120 and the inlet 142 of the core unit 140 are cooled by the water jacket 180, the EGR gas flowing therein decreases in temperature. Accordingly, the temperature limit required for the materials of the intake pipe 120 and the core unit 140 is reduced, so it is possible to select from a wider range of materials.

Further, the ability to reduce temperature at the inlet 142 greatly influences the cooling efficiency of the EGR cooler 100. That is, the temperature of the EGR gas entering the EGR cooler 100 greatly influences the overall cooling performance while the EGR gas flows through the EGR cooler 100.

According to an exemplary embodiment of the present invention, as the water jacket 180 covers the intake pipe 10, the EGR gas flowing into the EGR cooler 100 is pre-cooled, and accordingly, the temperature of the EGR gas entering the core unit 140 is greatly decreased, so the cooling performance of the EGR cooler 100 is improved.

The water jacket 180 covers the intake pipe 120, and may be positioned to cover the connection section of the core unit 140. The water jacket 180 may be hermetically formed to prevent the cooling water therein from leaking outside and is connected with the cooler housing 160, so the cooling water can flow therebetween.

Further, a cooling water inlet 182 may be formed at one of the water jacket 180 and the cooler housing 160 to provide a passage for the cooling water in one of them to flow to the other one, which will be preferable for designing an efficient structure.

Meanwhile, to connect the water jacket 180 and the cooler housing 160 to each other, a channel for connecting them may be formed or, the water jacket 180 and the cooler housing 160 may be open and combined to share the open sides.

Referring to FIG. 1, a water jacket 180 formed in the shape of a chamber having an internal space and covering the intake pipe 120 is combined with the cooler housing 160 to share a side with it. Accordingly, the water jacket 180 and the cooler housing 160 share the cooling water.

FIG. 2 shows a cross-section of the water jacket 180 connected with the cooler housing 160 to allow cooling water to flow therein and covering the intake pipe 120 to cool the EGR gas that flows in the core unit 140 through the intake pipe 120.

As a result, according to an exemplary embodiment of the present invention, since the water jacket 180 covers the intake pipe 120, it is possible to reduce the temperature of the EGR gas flowing into the core unit 140 at an earlier stage. Accordingly, it is possible to increase the range of materials for the intake pipe 120 and the core unit 140 and it is also possible to greatly improve the cooling performance of the EGR cooler 100 by pre-cooing the EGR gas flowing into the core unit 140.

On the other hand, the core unit 140 includes aluminum in the EGR cooler 100 for a vehicle according to an exemplary embodiment of the present invention.

As described above, the intake pipe 120 and the core unit 140 may include materials of which the temperature limits are considered to prevent deformation or burning due to the high temperature of the EGR gas flowing through them.

The temperature of the EGR gas that is not cooled yet through the core unit 140 is very high, so the material of the core unit 140 may be determined in consideration of the temperature of the EGR gas at the inlet of the EGR cooler.

When there is no water jacket 180 for cooling the intake pipe 120 that is the passage for EGR gas to flow into the core unit 140, the core unit 140 may include stainless steel to resist the high temperature at the inlet 142 of the core unit 140.

However, when the water jacket 180 covers the intake pipe 120 to cool the EGR gas, which comes out of the intake pipe 120, upstream of the core unit 140, the temperature of the inlet 142 of the core unit 140 is largely decreased, so it is possible to form the core unit 140 using aluminum having a temperature limit lower than that of stainless steel.

when aluminum is used for the core unit 140, formability is improved compared to when stainless steel is used, so the manufacturing efficiency is improved and the unit cost of the material is decreased, whereby manufacturing costs are reduced.

Further, aluminum has thermal conductivity higher than that of stainless steel, so using aluminum to form the core unit 140 can improve the cooling efficiency of the EGR gas.

As a result, because the water jacket 180 that cools the intake pipe 120 is mounted at an exemplary embodiment of the present invention, the temperature of EGR gas is reduced at the inlet of the core unit 140, and thus the efficiency with which the EGR gas is cooled is improved. Further, the core unit 140 may include aluminum, so cooling efficiency is improved, which is advantageous in terms of manufacturing.

Further, as shown in FIG. 1, in the EGR cooler 100 for the vehicle according to an exemplary embodiment of the present invention, the water jacket 180 has a cooling water inlet 182 and the cooler housing 160 receives cooling water from the water jacket 180.

In detail, in an exemplary embodiment of the present invention, cooling water for cooling EGR gas flows into the water jacket 180 and then flows into the cooler housing 160 from the water jacket 180, so the cooling water for cooling EGR gas can flow without stopping, whereby an effective cooling structure is achieved.

The cooling water flowing through the water jacket 180 or the cooler housing 160 may be configured to flow inside and outside while flowing through the entire space provided for cooling EGR gas.

When the cooling water inlet 182 is formed at the cooler housing 160, a cooling water outlet may be formed at the water jacket 180 and the cooler housing 160. Alternatively, the cooling water inlet 182 may be formed at an end of the cooler housing 160 that is spaced apart from the water jacket 180 and a cooling water outlet may be formed at the water jacket 180, but in this case, the flow direction of the cooling water is opposite to the flow direction of the EGR gas.

Accordingly, the cooling water for cooling the EGR gas at the upstream side, at which it has the highest temperature and requires the highest cooling level, has already exchanged heat with the EGR gas on the downstream side, so the EGR gas on the upstream side is not cooled, which may deteriorate the efficiency with which the EGR gas is cooled.

Therefore, in an exemplary embodiment of the present invention, the cooling water inlet 182 is positioned at the water jacket 180 at a position further upstream than the core unit 140, and the cooling water outlet is positioned downstream from the cooler housing 160, whereby the structure for smooth flow of the cooling water is simplified and the flow direction of the cooling water becomes a same as the flow direction of the EGR gas, maximizing the cooling performance.

On the other hand, as shown in FIG. 1 and FIG. 2, in the EGR cooler 100 for a vehicle according to an exemplary embodiment of the present invention, the cooling water inlet 182 is formed to face the inlet 122 of the intake pipe 120, so cooling water is discharged toward the inlet 122 of the intake pipe 120.

In detail, from the inlet 122 to the outlet 124 of the intake pipe 120, the temperature is highest at the inlet 122, so the cooling water inlet 182 is arranged to face the inlet 122 of the intake pipe 120 to improve the cooling ability at the inlet 122 of the intake pipe 120 in an exemplary embodiment of the present invention.

Accordingly, the cooling water discharged into the water jacket 180 through the cooling water inlet 182 intensively flows into the inlet 122 of the intake pipe 120. Accordingly, the cooling water preferentially cools the inlet 122 compared to other portions of the intake pipe 120, which is advantageous in improving the cooling performance for the inlet 122 of the intake pipe 120.

Referring to FIG. 1, the cooling water inlet 182 is positioned ahead of the inlet 122 of the intake pipe 120, which is in contact with the inside of the water jacket 180, so that they face each other in accordance with an exemplary embodiment of the present invention.

FIG. 2 is a cross-sectional view taken along line A-A in FIG. 1, in which a position of the cooling water inlet 182 positioned ahead of the inlet 122 of the intake pipe 120 is indicated by 'B' as an embodiment.

As shown in FIG. 2, a plurality of heat dissipation fins 125 extending in the flow direction E of EGR gas is positioned in the intake pipe 120 in the EGR cooler 100 for a vehicle according to an exemplary embodiment of the present invention.

The heat dissipation fins 125, which include a same material as the intake pipe 120, may be integrally or monolithically formed with the intake pipe 120 or may be separately formed and then positioned in the intake pipe 120. The heat dissipation fins 125 may be arranged in the shape of a column crossing the intake pipe 120 and may have various cross-sectional shapes.

Referring to FIG. 2, a plurality of rod-shaped heat dissipation fins 125 may be arranged in the shape of a column extending across the flow direction of the EGR gas in the intake pipe 120 as an exemplary embodiment of the present invention.

In an exemplary embodiment of the present invention, since the heat dissipation fins 125 are positioned in the intake pipe 120, the amount of heat exchange between the cooling water flowing through the water jacket 180 and the EGR gas in the intake pipe 120 is increased, so the EGR gas is further pre-cooled through the intake pipe 120 before being cooled through the core unit 140.

Further, as shown in FIG. 2, in the EGR cooler 100 for a vehicle according to an exemplary embodiment of the present invention, the heat dissipation fins 125 are arranged perpendicular to the flow direction E of the EGR gas and, the distance between them increases moving to the core unit 140 such that the flow cross-sectional area of the EGR gas decreases.

In detail, as the heat dissipation fins 125 are arranged in a direction H perpendicular to the flow direction E of the EGR gas, the EGR gas flows across the heat dissipation fins 125 through the intake pipe 120.

Under these circumstances, since the distance between the heat dissipation fins 125 decreases moving toward the core unit 140, the EGR gas increases in speed while moving past the heat dissipation fins 125 having the decreasing flow cross-sectional area. Accordingly, fluidity of the EGR gas is improved and the cooling efficiency is correspondingly improved.

Referring to FIG. 2, the heat dissipation fins 125 are arranged in the direction H perpendicular to the flow direction E of EGR gas and the distance between the heat dissipation fins 125 decreases moving from the upstream side to the downstream side in the flow direction E of the EGR gas.

Further, as shown in FIG. 2, in the EGR cooler 100 for a vehicle according to an exemplary embodiment of the present invention, the heat dissipation fins 125 increase in thickness moving toward the core unit 140, so the distance between the heat dissipation fins decreases.

In detail, the heat dissipation fins 125 may be arranged such that the distance between them decreases moving toward the core unit 140 through various shapes, but in an exemplary embodiment of the present invention, the heat dissipation fins 125 increase in thickness closer to the core unit 140, so that the distance between the heat dissipation fins decreases.

Referring to FIG. 2, a thickness of the heat dissipation fins 125 increases moving toward the rear end 126 adjacent to the core unit 140 from the front end 127 adjacent to the upstream side in the intake pipe 120.

Further, as shown in FIG. 2, in the EGR cooler 100 for a vehicle according to an exemplary embodiment of the present invention, the heat dissipation fins 125 have different lengths determined in accordance with the positions.

In detail, the heat dissipation fins 125 improve the fluidity by guiding the EGR gas flowing into the core unit 140 through the intake pipe 120. Further, the intake pipe 120 may extend in various shapes for spatial efficiency in the engine compartment. Accordingly, the EGR gas flowing to the inlet 142 of the core unit 140 may have locally different flow directions and speeds, depending on the position in the intake pipe 120 due to the extending shape of the intake pipe 120.

For example, when the intake pipe 120 bends upstream of the core unit 140, as shown in FIG. 2, the EGR gas flowing in the extension direction of the intake pipe 120 turns along a longitudinal direction of the intake pipe 120.

The EGR gas passing the bending portion increases in flow speed and flow rate at a position having a larger turning radius than at a position having a smaller turning radius, which is the inside. Further, the EGR gas decreases in flow speed and flow rate while passing the inside, which has a relatively small turning radius.

That is, depending on the extension shape of the intake pipe 120 including the case shown in FIG. 2 in which the pipe 120 may have a bending portion, the EGR gas flowing to the inlet 142 of the core unit 140 decreases in uniformity of flow and enters the channels of the core unit 140 at different flow rates, so the efficiency of cooling the EGR gas may be reduced.

Accordingly, in an exemplary embodiment of the present invention, the heat dissipation fins 125 are given different lengths, depending on their positions in the intake pipe 120.

For example, longer heat dissipation fins 125 are positioned further upstream than shorter heat dissipation fins 125 and distribute some of the EGR gas at the upstream side, so the reduction in the flow rate due to bending can be mitigated. Further, the lengths of the heat dissipation fins 125 may be determined to prevent a change in flow rate attributable to their positions in the intake pipe 120 for various reasons.

Accordingly, in an exemplary embodiment of the present invention, heat dissipation fins 125 having predetermined lengths are positioned further upstream than the core unit 140, where the flow of the EGR gas may not be uniform, in accordance with the extension shape of the intake pipe 120, so the uniformity of flow of the EGR gas is improved so that EGR gas can be uniformly distributed among the channels of the core unit 140, improving the cooling performance.

Referring to FIG. 2, the bending intake pipe 120 is positioned upstream of the core unit 140, and the heat dissipation fins 125 that are located at an outside and have a larger turning radius due to the bending of the intake pipe 120 are given shorter lengths than the heat dissipation fins 125 that are located at the inside and have a smaller turning radius, so the heat dissipation fins 125 are arranged to prevent a decrease in the uniformity of flow due to the bending.

Further, as shown in FIG. 2, in the EGR cooler 100 for a vehicle according to an exemplary embodiment of the present invention, the intake pipe 120 has an expanding section where the internal cross-sectional area increases moving toward the core unit 140 and at least at least one of the heat dissipation fins 125 are arranged such that the front ends 127 facing the upstream side in the intake pipe are in contact with the inside of the expanding section 130.

In detail, the intake pipe 120 has the expanding section 130 that increases in internal cross-sectional area closer to the inlet 142 of the core unit 140. The expanding section 130 may have a cross-sectional area corresponding to the cross-sectional area of the inlet 142 of the core unit 140.

Since the cross-sectional area increases at the expanding section 130 to thus correspond to the cross-sectional area of the inlet 142 of the core unit 140, the flow cross-sectional area of the EGR gas flowing through the intake pipe 120 also increases, so the EGR gas flowing to the inside of the expanding section 130 flows into the expansion space at the expanding section 130, and thus stagnates or creates a vortex.

That is, the EGR gas may decrease in fluidity and stagnate in the space expanded by the expanding section 130. Accordingly, in an exemplary embodiment of the present invention, at least at least one heat dissipation fins 125 are arranged such that the front ends 127 are in contact with the inside of the expanding section 130 of the intake pipe 120.

The heat dissipation fins 125, which are arranged such that the front ends 127 are in contact with the inside of the expanding section 130, are positioned at an outside of the plurality of heat dissipation fins 125. Further, when the expanding section 130 is formed at the downstream side where the bending portion is formed, as shown in FIG. 2, a vortex may be formed adjacent to the inside of the expanding section 130 corresponding to the inside of the turning range formed by the bending portion and the EGR gas may stagnate in that portion.

Accordingly, referring to FIG. 2 showing an exemplary embodiment of the present invention, the outermost heat dissipation fin 125, among the plurality of heat dissipation fins 125, is arranged such that the front end 127 is in contact with the inside of the expanding section 120, which specifically corresponds to the inside of the turning range formed by the bending portion.

Therefore, in an exemplary embodiment of the present invention, since at least one heat dissipation fins 125 are arranged such that the front ends 127 are in contact with the inside of the expanding section 130, fluidity of the EGR gas is improved and the cooling performance can be improved.

Further, as shown in FIG. 2, in the EGR cooler 100 for a vehicle according to an exemplary embodiment of the present invention, the intake pipe 120 has a bending portion 27 upstream of the expanding section 130 such that a longitudinal direction changes and the curvature of the inside sequentially changes in a longitudinal direction through the bending portion 127 and the expanding section 130.

The sequential change of the curvature of the inside means that the curvature sequentially changes in a longitudinal direction while the inside bends, forming a curved surface.

In this configuration, the curvature is not discontinuously changed in a section that is flat with a curvature of 0, so it will be understood that the curvature of the inside is sequentially changed in the embodiment of the present invention. However, it should be understood that the case where a surface bends such that an edge is formed while extending in a longitudinal direction corresponds to the case where the curvature is not sequentially changed.

In an exemplary embodiment of the present invention, the intake pipe 120 has the bending portion 127 that changes its longitudinal direction in the water jacket 180. The amount of bending in a longitudinal direction that is achieved by the bending portion 127 may be determined in various ways, preferably in consideration of the design of the exhaust gas channels and the inside of the engine compartment.

The layout of the EGR cooler 100 including the position and the shape can be determined in accordance with the relationships between various configurations including the exhaust gas channels and the exhaust gas purifier, and when the bending portion 127 is formed in the intake pipe 120, the flexibility of use of space is improved.

Further, when the bending portion is formed, the exhaust gas flowing through the intake pipe 120 also changes the flow direction E and this directional change may deteriorate the uniformity of flow of the exhaust gas at the inlet 142 of the core unit 140. When the flow direction changes, some of the exhaust gas may cause a swirl or a turbulent flow, decreasing fluidity.

The deterioration of the fluidity of exhaust gas is easily caused when the flow direction E of the exhaust gas bends and non-sequentially changes. Accordingly, in an exemplary embodiment of the present invention, to achieve spatial efficiency, the bending portion 127 is formed in the intake pipe 120 and the intake pipe 120 is formed such that the inside sequentially changes in curvature after the bending portion 127 (that is, the inside does not bend while extending).

Accordingly, the intake pipe 120 can change a longitudinal direction and prevent or minimize the deterioration of fluidity of exhaust gas.

Further, when the bending portion 127 is formed in the intake pipe 120 and the expanding section 130 is also formed at the downstream side from the bending portion 127, the possibility of unstable flow of exhaust gas increases.

Therefore, in an exemplary embodiment of the present invention, the inside of the intake pipe 120 extends when the bending portion 127 and the expanding section 130 are formed, but when a longitudinal direction changes, the change of the curvature is sequentially made in a longitudinal direction, preventing or mitigating an impediment to the flow of exhaust gas.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exhaust gas recirculation (EGR) cooler for a vehicle, the EGR cooler comprising:

an intake pipe through which EGR gas flows;

a core unit having an inlet connected to the intake pipe and having a plurality of channels into which EGR gas flows through the intake pipe;

a cooler housing that covers the core unit and through which cooling water flows to cool a cover unit; and a water jacket that covers the intake pipe and is connected to the cooler housing, and through which the cooling water flows to cool the intake pipe, wherein a plurality of heat dissipation fins having lengths extending in a flow direction of the EGR gas is positioned in the intake pipe, and wherein the heat dissipation fins are arranged perpendicular to the flow direction of the EGR gas and a distance between the heat dissipation fins decreases moving toward the core unit so that a flow cross-sectional area of the EGR gas decreases.

2. The EGR cooler of claim 1, wherein the core unit includes aluminum.

3. The EGR cooler of claim 1, wherein a cooling water inlet is formed at the water jacket and the cooler housing receives cooling water from the water jacket.

4. The EGR cooler of claim 3, wherein the cooling water inlet is positioned to face an inlet of the intake pipe such that cooling water is discharged toward the inlet of the intake pipe.

5. The EGR cooler of claim 1, wherein a thickness of the heat dissipation fins increases moving toward the core unit to decrease the distance between the heat dissipation fins.

6. The EGR cooler of claim 1, wherein the heat dissipation fins have different lengths in accordance with positions thereof.

7. The EGR cooler of claim 1, wherein the intake pipe has an expanding section of which an internal cross-sectional area increases moving toward the core unit, and at least one of the heat dissipation fins are arranged such that front ends of the heat dissipation fins, in which the front ends of the of the heat dissipation fins face an upstream side in the intake pipe, are in contact with an inside of the expanding section.

8. The EGR cooler of claim of 6, wherein the intake pipe has a bending portion upstream side of an expanding section to change a longitudinal direction, and a curvature of an inside of the intake pipe sequentially changes in a longitudinal direction through the bending portion and the expanding section.

* * * * *